US007429907B2

(12) United States Patent
Tung et al.

(10) Patent No.: US 7,429,907 B2
(45) Date of Patent: Sep. 30, 2008

(54) POWER INDUCTOR WITH HEAT DISSIPATING STRUCTURE

(75) Inventors: Mean-Jue Tung, Hsinchu (TW); Wen-Song Ko, Hsinchu (TW); Yu-Ting Huang, Hsinchu (TW); Ping-Feng Hsu, Taipei County (TW); Yen-Ping Wang, Hsinchu County (TW)

(73) Assignee: Industrial Technology Research Institu, Hsin-Chu (TW)

( * ) Notice: Subject to any disclaimer, the term of this patent is extended or adjusted under 35 U.S.C. 154(b) by 0 days.

(21) Appl. No.: 11/553,936

(22) Filed: Oct. 27, 2006

(65) Prior Publication Data

US 2007/0152792 A1 Jul. 5, 2007

(30) Foreign Application Priority Data

Dec. 29, 2005 (TW) ..... 94147141 A

(51) Int. Cl.
*H01F 27/08* (2006.01)

(52) U.S. Cl. ..... 336/61; 336/55

(58) Field of Classification Search ..... 336/15, 336/55, 57, 60, 61

See application file for complete search history.

(56) References Cited

U.S. PATENT DOCUMENTS 6,075,491 A * 6/2000 Dakeya et al. ..... 343/722
6,144,282 A * 11/2000 Lee ..... 336/234
6,460,244 B1 10/2002 Shafer et al.
6,486,763 B1 11/2002 Kummel
6,621,397 B2 9/2003 Hsu
6,741,154 B2 * 5/2004 Kawasaki et al. ..... 336/200
2006/0157798 A1 * 7/2006 Hayashi et al. ..... 257/374

FOREIGN PATENT DOCUMENTS

JP 2000-306751 2/2000
JP 2001-35731 9/2001

* cited by examiner

*Primary Examiner*—Anh T Mai
(74) *Attorney, Agent, or Firm*—WPAT, P.C.; Justin I. King

(57) ABSTRACT

The present invention relates to a power inductor having a heat dissipating structure formed on the surface thereof, which comprises: at least a conducting wire; and a cladding, made of a magnetic material for wrapping the conductive wire, having the heat dissipating structure of embossed patterns formed on the surface thereof. Preferably, the embossed pattern can be a cone, a cuboid, a column, or the combination thereof. Moreover, the length of any edge or the diameter of any one of the embossed patterns is about 1%~50% of that of the power inductor, and the height of any one of the embossed patterns is about 1%~50% of the thickness of the power inductor.

16 Claims, 6 Drawing Sheets

POWER INDUCTOR WITH HEAT DISSIPATING STRUCTURE

FIELD OF THE INVENTION

The present invention relates to a power inductor with heat dissipating structure, and more particularly, to a power inductor capable of lowering the temperature rise for a given input.

BACKGROUND OF THE INVENTION

As the design of modern electronic device is moving toward lighter, thinner and smaller while integrating multiple functions, heat dissipation is becoming an urgent problem that required to be solved since an electronic device with poor heat dissipating efficiency may cause the whole system to become unstable, which is especially true for those future low-voltage high-current central processing units (CPUs). As the future inductors, especially those adapted for CPUs, are designed to cope with high current and high power, it is inevitably that the temperatures of those inductors are increased with the high working current flowing therethrough, and consequently, the temperature of substrates, where the inductors are arranged, and other electronic devices, arranged on the substrates at positions proximate to the inductors, will all be affected thereby and thus raised. Conventionally, the aforesaid heat dissipating problem is solved by arranging additional heat dissipating devices, such as heat pipe or liquid cooling device, in the system. However, since the additional heat dissipating devices will cause additional cost to the electronic device using the same and thus diminish the competitiveness of the resulting products, it is preferred to resolve the heat dissipating problem directly by the design of the inductor itself.

Therefore, It is in need of an improved high-power high-current inductor with heat dissipating structure.

SUMMARY OF THE INVENTION

"In view of the disadvantages of prior art, the primary object of the present invention is to provide inductors, adapted for high-current high-power applications, which is capable of lowering the temperature rise for a given input without the help of additional heat dissipating devices, while preventing its working current and resulting inductance from being adversely affected by heat dissipating patterns regularly formed on the surface of the inductor."

To achieve the above object, the present invention provides a power inductor having a heat dissipating structure formed on the surface thereof, which comprises: at least a conducting wire; and a cladding, made of a magnetic material for wrapping the conductive wire, having the heat dissipating structure of embossed patterns formed on the surface thereof; wherein, any one of the embossed patterns is formed as a shape selected from the group consisting of a cone, a cuboid, a column, and the combination thereof; and the length of any edge/diameter of any one of the embossed patterns is ranged between 1%~50% of that of the power inductor; and the height of any one of the embossed patterns is ranged between 1%~50% of the thickness of the power inductor.

In a preferred aspect, the arrangement of the embossed patterns on the cladding is designed to make the best use of the magnetic material while maintaining the optimized magnetic circuit, that is, the concaves of the cladding, caused by the embossed patterns, are not blocking the magnetic flux lines generating from the current inside the conducting wire for keeping the distribution of magnetic flux at minimum magnetic reluctance.

Preferably, the cladding is formed as a cuboid having at least a surface thereof formed with the embossed patterns. In another preferred aspect, the cladding is formed as a column having at least a circular surface thereof formed with the embossed patterns.

Preferably, the embossed patterns are arranged on the cladding in a radiation manner while arranging a circular embossed pattern at the center of the radiation. In another preferred aspect, the embossed patterns are arranged on the cladding as a matrix.

Other aspects and advantages of the present invention will become apparent from the following detailed description, taken in conjunction with the accompanying drawings, illustrating by way of example the principles of the present invention.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

It is intended to provide a power inductor having a heat dissipating structure formed on the surface thereof in the invention, which is capable of lowering the temperature rise for a given input by the increased surface heat dissipating area achieved by the formation of surface patterns on the power inductor. It is noted that, by pressing directly a mold punch with specific pattern design upon the surface of a magnetic material so as to form a cladding with embossed patterns for the power inductor, the surface area of the resulting power inductor is larger than those conventional planar inductor so that the power inductor with increased surface area is adapted for high-current high-power applications. Moreover, the arrangement of the embossed patterns on the cladding is designed to make the best use of the magnetic material while maintaining the optimized magnetic circuit, that is, the concaves of the cladding, caused by the embossed patterns, are not blocking the magnetic flux lines generating from the current inside the conducting wire for keeping the distribution of magnetic flux at minimum magnetic reluctance. Therefore, the working current of the power inductor will not be adversely affected by the heat dissipating structure regularly arranged at the surface of the inductor, and thus the resulting power inductor is adapted for high-current high-power applications, which is capable of lowering the temperature rise for a given input without the help of additional heat dissipating devices.

Figure 1:
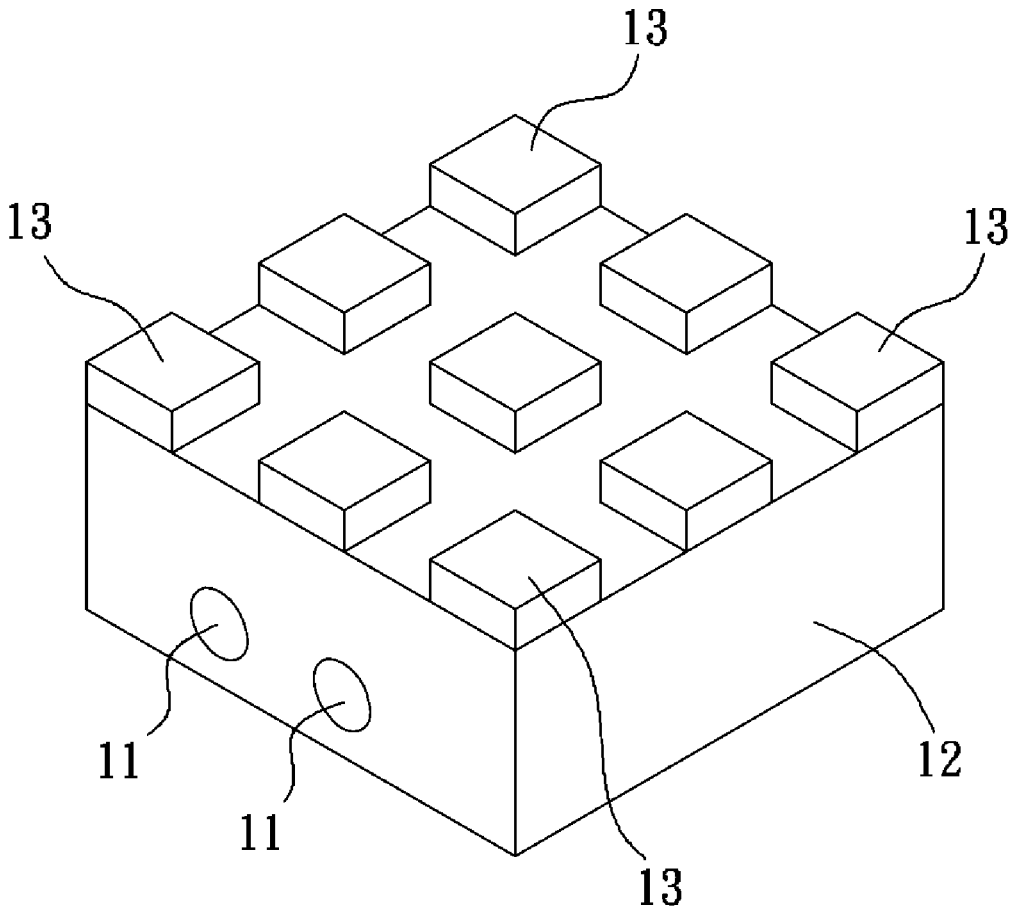
FIG. 1 is a schematic view of a power inductor having a heat dissipating structure formed on the surface thereof according to a first embodiment of the invention.

Please refer to FIG. 1, which is a schematic view of a power inductor having a heat dissipating structure formed on the surface thereof according to a first embodiment of the invention. The power inductor of FIG. 1 is comprised of a conducting wire 11 and a cladding 12 made of a magnetic material. Preferably, the conducting can be made of copper, silver, aluminum, gold or the composite of any one or two of the aforesaid materials. For instance, one composite can be a copper wire coated with a silver coating. Moreover, a heat dissipating structure 13 of a plurality of embossed patterns is formed on the surface of the cladding 12, whereas the group consisting of a cone, a cuboid, a column, and the combination thereof; and the length of any edge/diameter of any one of the embossed patterns is ranged between 1%~50% of that of the power inductor; and the height of any one of the embossed patterns is ranged between 1%~50% of the thickness of the power inductor.

"In a preferred embodiment of the invention, the cladding 12 is formed as a cuboid having at least a surface thereof formed with the heat dissipating structure of the embossed patterns 13. However, there can be more than one surface of the cladding being formed with the heat dissipating structure of embossed patterns 13, but is not limited thereby. Moreover, the cladding 12 is not limited to be a cuboid, and thus it can be a cone, a pyramid, a column, an oval-shaped object, a circular-shaped object or any other irregular-shaped objects. In another preferred aspect, the heat dissipation structure of embossed patterns 13, formed on the surface of the cladding 12, is manufactured by pressing directly a mold punch with specific pattern design upon the surface of a magnetic material. Preferably, the magnetic material can be iron, cobalt, nickel, or alloys, compounds or oxides of the aforesaid metals, or the combinations thereof; wherein any of the magnetic oxide is selected from the group consisting of Mn—Zn ferrites, Ni—Zn ferrites, Cu—Zn ferrites, Ni—Cu—Zn ferrites, Mg—Zn ferrites, Li—Zn ferrites."

In FIG. 1, the heat dissipating structure 13 is a matrix of nine cuboid embossed patterns uniformly distributed on a surface of a power inductor of cuboid shape. By measuring the surface temperature of the power inductor with respect to its output current using a thermal couple, the surface temperature of the power inductor is lowered by 10%, comparing to conventional planar inductors, that illustrates the effectiveness of the invention.

Figure 2:
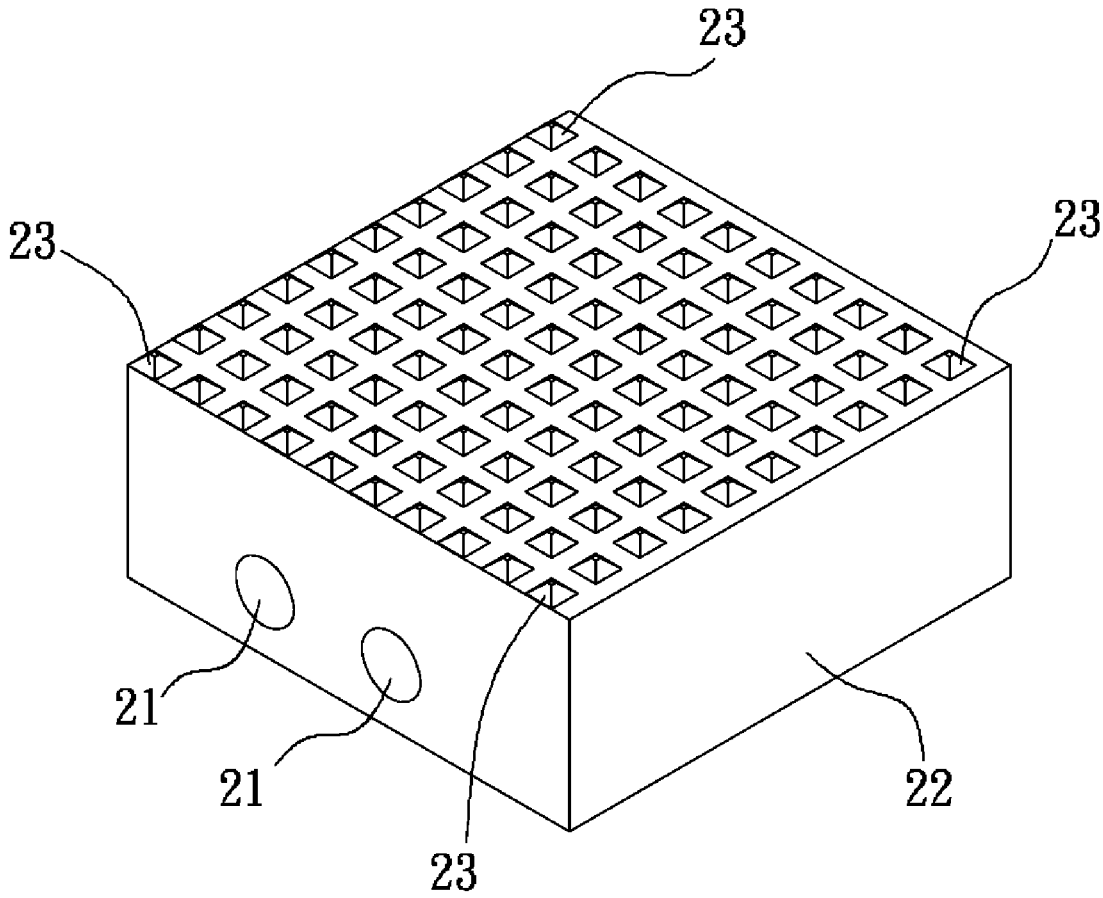
FIG. 2 is a schematic view of a power inductor having a heat dissipating structure formed on the surface thereof according to a second embodiment of the invention.

Please refer to FIG. 2, which is a schematic view of a power inductor having a heat dissipating structure formed on the surface thereof according to a second embodiment of the invention. In FIG. 2, the heat dissipating structure 23 is a matrix of a plurality of pyramids uniformly distributed on a surface of a power inductor of cuboid shape. It is noted that the power inductor of such heat dissipating structure of FIG. 2 can effectively lower its surface temperature by 15%.

Figure 3:
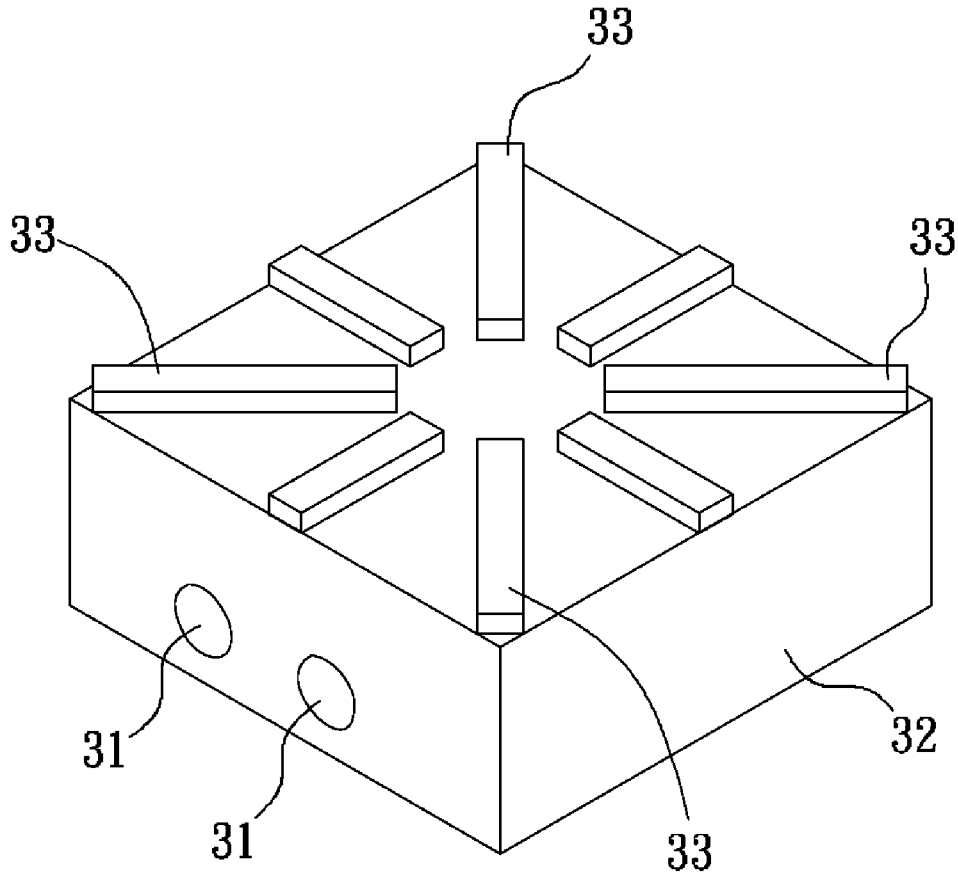
FIG. 3 is a schematic view of a power inductor having a heat dissipating structure formed on the surface thereof according to a third embodiment of the invention.
Figure 4:
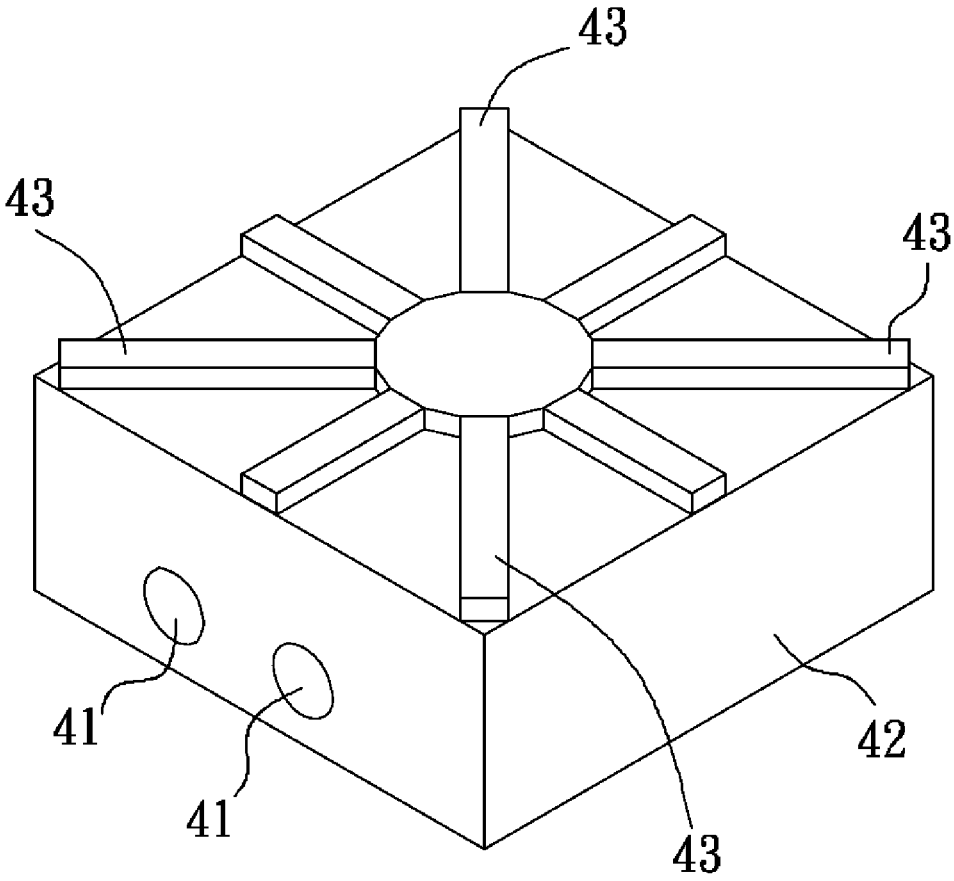
FIG. 4 is a schematic view of a power inductor having a heat dissipating structure formed on the surface thereof according to a fourth embodiment of the invention.
Figure 5:
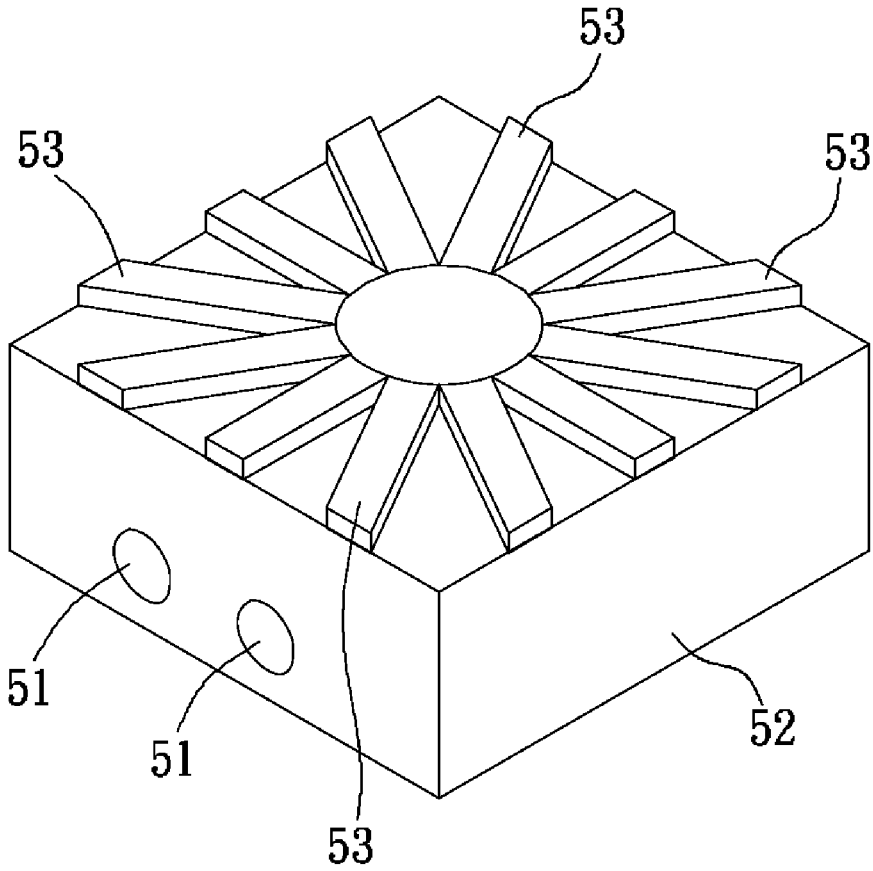
FIG. 5 is a schematic view of a power inductor having a heat dissipating structure formed on the surface thereof according to a fifth embodiment of the invention.

Please refer to FIG. 3, FIG. 4 and FIG. 5, which are respectively a third, a fourth, and a fifth embodiments of the invention. In FIG. 3, the heat dissipating structure is comprised of a plurality of radial-arranged embossed patterns, each extending from the center of a surface of the power inductor toward the edge thereof. The differences between the three embodiments of FIG. 3, FIG. 4 and FIG. 5 are that: there is an addition circular embossed patterned formed in the center of the radially arranged embossed pattern of FIG. 4 while there is none in FIG. 3; and the embossed patterns are distributed more densely in FIG. 5 than that of FIG. 4. However, comparing to those conventional planar inductors, all of which can raise their rated current by 16%, or can lower their temperature rise by 10% for the same input. Thus, all the three power inductors of different heat dissipating structures, as shown in FIG. 3, FIG. 4 and FIG. 5, are capable of lowering surface temperature rise for a given input while raising rated current.

Figure 6:
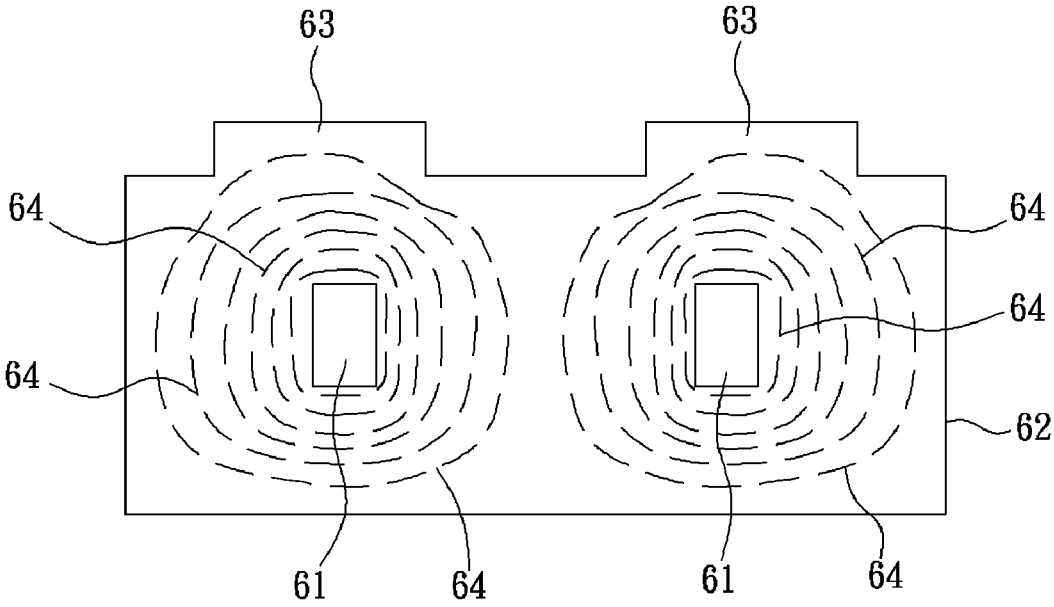
FIG. 6 shows the distribution of the magnetic flux lines inside a power inductor of the invention.

Please refer to FIG. 6, which shows the distribution of the magnetic flux lines inside a power inductor of the invention. In FIG. 6, as the heat dissipating structure of embossed patterns is only formed on the surface of the power inductor of the invention, the distribution of the magnetic flux lines 64 are regulated by Ampere's Right-Hand Rule and the magnetic circuit can be maintained at optimized manner. Since the magnetic flux lines 64 of conventional planar inductor might sometimes being blocked while the volume of the planar inductor is not large enough, the power inductor with heat dissipating structure of the invention is free from the aforesaid problem, and thus the power of the inductor of the invention is enhanced comparing to those planar inductors, In addition, as the surface area of the power inductor of the invention is increased, the rise of the surface temperature can be further reduced.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A high-current and high-power power inductor having a heat dissipating structure formed on the surface, comprising:

at least a conducting wire;

a cladding, made of a magnetic material for wrapping the conductive wire, having the heat dissipating structure of embossed patterns formed on the surface thereof, and wherein said embossed patterns is formed in a shape selected from a group consisting of a cone, a cuboid, and the combination thereof.

2. The power inductor of claim 1, wherein said embossed patterns do not block said conductive wire's magnetic flux lines.

3. The power inductor of claim 1, wherein the length of any edge/diameter of any one of the embossed patterns is ranged between 1%~50% of that of the power inductor.

4. The power inductor of claim 1, wherein the height of any one of the embossed patterns is ranged between 1%~50% of the thickness of the power inductor.

5. The power inductor of claim 1, wherein the magnetic material is a material selected from the group consisting of iron, cobalt, nickel and alloys made of at least two aforesaid metals.

6. The power inductor of claim 1, wherein the magnetic material is a material selected from the group consisting of iron compounds, cobalt compounds and nickel compounds.

7. The power inductor of claim 1, wherein the magnetic material is a magnetic oxide selected from the group consisting of iron oxides, cobalt oxides and nickel oxides.

8. The power inductor of claim 7, wherein any of the magnetic oxide is selected from the group consisting of Mn—Zn ferrites, Ni—Zn ferrites, Cu—Zn ferrites, Ni—Cu—Zn ferrites, Mg—Zn ferrites, Li—Zn ferrites.

9. The power inductor of claim 1, wherein the cladding of embossed patterns is manufactured by pressing directly a mold punch with specific pattern design upon the surface of the magnetic material.

10. The power inductor of claim 1, wherein any one of the embossed patterns is substantially a cuboid.

11. The power inductor of claim 1, any one of the embossed patterns is substantially a cone.

12. The power inductor of claim 1, wherein the embossed patterns are radially arranged on the cladding.

13. The power inductor of claim 12, wherein a circular embossed pattern is arranged at the center of the radiation.

14. The power inductor of claim 1, wherein the embossed patterns are arranged on the cladding as a matrix.

15. A high-current and high-power power inductor having a heat dissipating structure formed on the surface, comprising:

at least a conducting wire;

a cladding, made of a magnetic material for wrapping the conductive wire, having the heat dissipating structure of embossed patterns formed on the surface thereof, and wherein said embossed patterns is formed in a first shape of a column and in a second shape selected from a group consisting of a cone, a cuboid, and the combination thereof.

16. The power inductor of claim 15 wherein said embossed patterns do not block said conductive wire's magnetic flux lines.

* * * * *

UNITED STATES PATENT AND TRADEMARK OFFICE

CERTIFICATE OF CORRECTION

PATENT NO. : 7,429,907 B2
APPLICATION NO. : 11/553936
DATED : September 30, 2008
INVENTOR(S) : Tung et al.

It is certified that error appears in the above-identified patent and that said Letters Patent is hereby corrected as shown below:

Title page

Item 73 – Assignee

"Diatech Pty. Ltd., Queensland (AU)" - should read "Industrial Technology Research Institute"

Signed and Sealed this

Fourteenth Day of April, 2009

JOHN DOLL
*Acting Director of the United States Patent and Trademark Office*